United States Patent [19]

Pyykkönen

[11] 4,403,944

[45] Sep. 13, 1983

[54] AUXILIARY DEVICE FOR OIL BURNER FOR MIXING WATER AND OIL FOR COMBUSTION

[76] Inventor: Pentti Pyykkönen, Kangasalantie 6, Järvenpää, Finland

[21] Appl. No.: 83,406

[22] Filed: Oct. 10, 1979

[51] Int. Cl.[3] ..... F23J 7/00

[52] U.S. Cl. ..... 431/90; 431/4; 123/25 E; 137/564.5

[58] Field of Search ..... 431/4, 90; 261/18 A; 123/25 R, 25 A, 25 E; 137/98, 564.5; 252/358; 366/176; 44/51

[56] References Cited

U.S. PATENT DOCUMENTS

| | | | |
|---|---|---|---|
| 3,766,942 | 10/1973 | Delatronchette et al. | 431/4 |
| 3,963,000 | 6/1976 | Kosaka et al. | 123/25 R |
| 4,144,015 | 3/1979 | Berthraume | 431/4 |

FOREIGN PATENT DOCUMENTS

| | | | |
|---|---|---|---|
| 539548 | 7/1955 | Belgium | 137/564.5 |
| 2604610 | 8/1977 | Fed. Rep. of Germany | 431/4 |

*Primary Examiner*—James C. Yeung
*Assistant Examiner*—Lee E. Barrett
*Attorney, Agent, or Firm*—Price, Heneveld, Huizenga & Cooper

[57] ABSTRACT

The invention utilizes a pump for delivering oil to the atomizing nozzle of a combustion chamber. The system includes a tank with a free piston by which oil introduced at one end from the pump forces water out at the other end at the same pressure as the oil discharged from the pump. The oil and water are then discharged through a pair of adjacent nozzles and mixed and then through an additional nozzle to further mix the oil and water and then conducted to the combustion chamber atomizing nozzle.

1 Claim, 1 Drawing Figure

AUXILIARY DEVICE FOR OIL BURNER FOR MIXING WATER AND OIL FOR COMBUSTION

Figure 1:
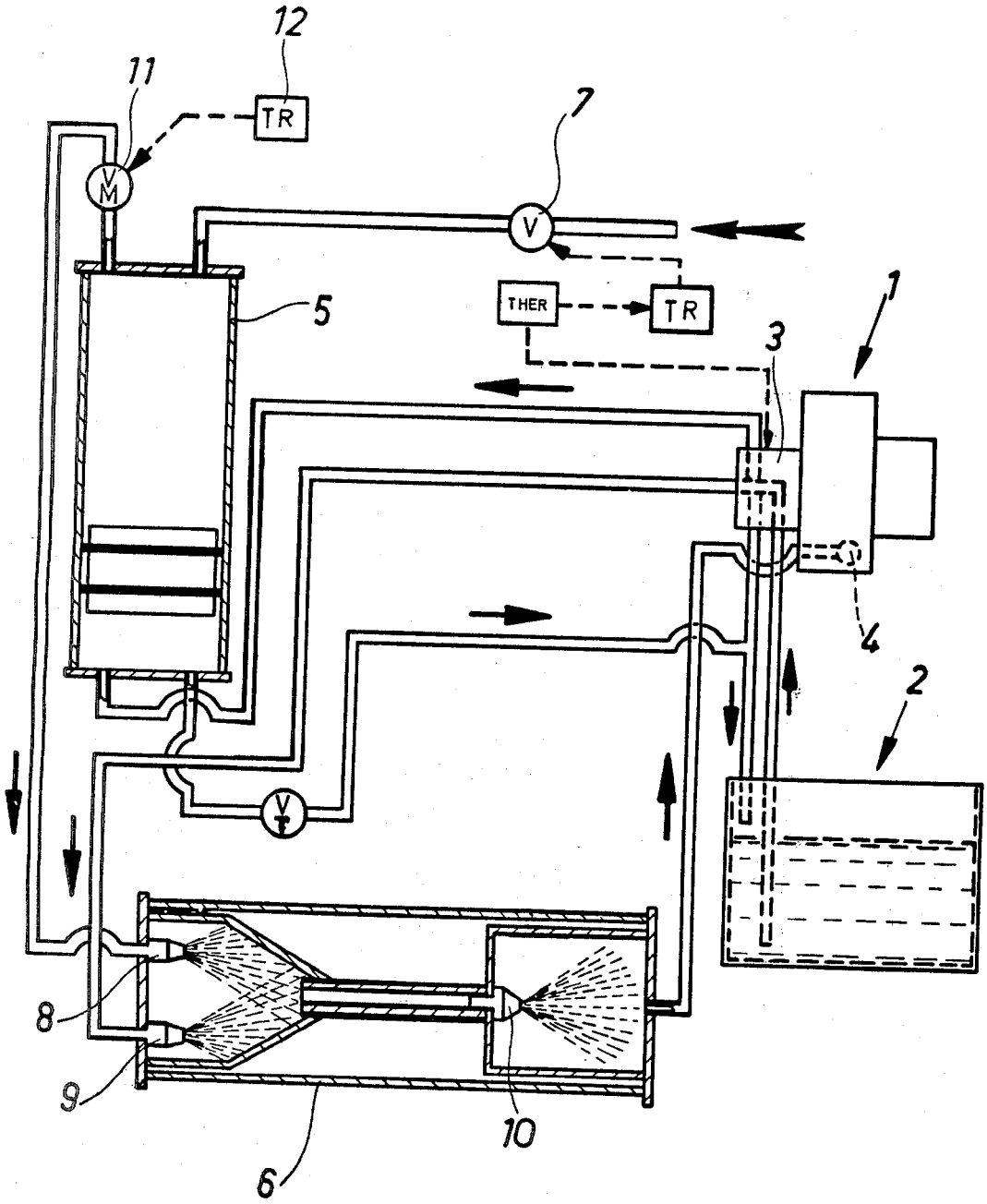

In order to enhance combustion, water has been sprayed into burners, internal combustion engines and even mixed with the oil intended for oil burners. This latter operation has taken place in the oil pump of an oil burner and has, however, resulted in several drawbacks.

The object of the present invention is to provide a reliably working auxiliary device for an oil burner for mixing water and oil together without disturbing normal operation of the oil burner and effectively enough to provide combustible fine particle mixture. What is novel and special about the invented device is that there is a mixer provided with water and oil spray nozzles as well as means for passing water and oil by pressure and at a given mutual ratio to spray nozzles of the mixer, said mixer being connected to the combustion nozzle of an oil burner for supplying the water-in-oil mixture therein for combustion.

The invention will be described in more detail in the following with reference made to the attached drawing in which FIG. 1 is a diagrammatic layout of the equipment for practicing this invention.

FIG. 1 shows an oil burner 1 and oil tank 2. In view of describing the invention, the most significant oil burner components are oil pump 3 and combustion nozzle 4 between which the auxiliary device of the invention is connected. The assembly of the invention comprises a water tank 5 and mixer 6. Water is supplied into the upper portion of tank 5 through a valve 7 which opens when the oil burner stops. The time valve 7 remains open is determined for example by means of a time relay in such a manner that tank 5 will be filled with water and valve 7 closed by the time the burner re-starts. After the start of the burner, the pressure of oil pump 3 acts below the piston in tank 5, the water above thus obtaining the same pressure as oil. Due to said pressure water is forced to a nozzle 8 at the end of the mixer. Beside this nozzle, there is preferably the same type of nozzle 9 for oil. Alternatively water and oil may be conducted to come into contact with each other just before the nozzles 8 and 9, whereby the mixture of oil and water is sprayed through both nozzles 8 and 9. Water and oil sprays produced by these nozzles encounter, whereby efficient mixing occurs and the mixture may be further sprayed at a common nozzle 10.

With the combustion continuing, the amount of water in tank 5 decreases and the piston pushes upwards. According to the arrangements generally employed in the present pressurized oil burner plants, the excessive oil is passed via a return pipe back in oil tank 2, as depicted in the drawing.

When a conventional thermostat assembly stops the oil burner, valve 7 is opened, water streams to the upper portion of tank 5, piston lowers and the oil therebelow flows along the return pipe into the oil tank. When tank 5 is filled with water, valve 7 is closed and the assembly is ready for action with the actuation of the oil burner.

The above description shows that water is not directed directly to the oil burner and that the supply pressure is not the same as water mains pressure. According to the invention, water is passed into a separate tank 5 and in that tank, with the start of combustion, water supply pressure is determined by oil supply pressure. In the assembly depicted in the FIGURE, water supply pressure is the same as oil supply pressure, but the pressure ratio can be changed by modifying the design. With the pressures of oil and water the same and nozzles 8 and 9 of the same size, the ratio of oil and water burned in nozzle 4 of oil burner 1 will be 50% to 50%. The practical tests have proven that the combustion is undisturbed and the flame is strong, white and unsooting so that the combustion can be presumed to be complete.

Theoretical explanation of combustion still remains hypothetical. We can assume that, with the mixing being effected by means of atomized sprays such an advantageous water-in-oil emulsion is obtained in nozzles that water in sufficient heat indeed participates in combustion reaction in an oil burner. It is conceivable that hot water vapours react with hydrocarbons producing carbon monoxide, whereafter the leftover hydrogen burns by means of oxygen in the combustion air to water and carbon monoxides to carbon dioxide. Thus, the purpose of water is to enhance complete combustion by small air excess or as almost stoichiometric combustion without the flame, however, becoming sooted.

Practical tests have proven that the mixture of oil and water obtained from atomized sprays of pressure nozzles remains unchanged for rather long periods, i.e. without water and oil separating from each other. However, the idea has been to dispose the small-size devide of the invention immediately adjacent an oil burner and preferably between the oil pump 3 and combustion nozzle 4 of an oil burner. If necessary, water tank 5 and mixer 6 can be connected into one constructional unit.

In order to control, the oil and water ratio it is favorable to provide the water pipe between the tank 5 and nozzle 8 by a magnetic valve 11 controlled by a time relay 12 allowing periodical water suply. By regulating the time set in the time relay 12 the oil and water ratio can be easily controlled. In addition or alternatively the oil pipe leading to nozzle 9 may be provided by same kind of control means.

The design will be particularly preferable when the assembly of the invention can be adapted to all light oil burners without modifying the design but by simply replacing the pipe between the pump 3 and the burner nozzle 4 by another provided with a T-branch for connecting it to the device of the invention.

I claim:

1. Apparatus for supplying a combustion mixture of oil and water to an oil burner having a combustion chamber, said apparatus including an oil supply, a tank and an oil pump and a discharge nozzle at the combustion chamber, said apparatus comprising: a piston mounted in said tank dividing said tank into two chambers, one for oil and one for water, said piston reciprocally movable lengthwise of said tank in response to pressure differentials acting on opposite sides thereof; a source of water under pressure connected to one of the chambers in said tank; a valve between said tank and its water source, means responsive to the firing of said oil burner for closing said valve while the oil burner is firing; conduit means connecting said oil pump to the other chamber in said tank to subject the water content of said tank to the same pressure as the oil being pumped by said pump; a first mixing chamber and a pair of adjacent nozzles, one of said nozzles being connected to said oil pump and the other being connected to said one chamber of said tank; for discharing both oil and water into said chamber to intermix the same; a second chamber and a third nozzle communicating with said first chamber for discharging the oil/water mix from said first chamber into said second chamber; conduit means interconnecting said second chamber with said discharge nozzle in said combustion chamber for conducting the oil/water mixture to said discharge nozzle.

* * * * *